US010563562B2

(12) United States Patent
Lampe et al.

(10) Patent No.: US 10,563,562 B2
(45) Date of Patent: Feb. 18, 2020

(54) EXHAUST PIPE ASSEMBLY AND METHOD OF FASTENING A SHEET-METAL TAB TO AN EXHAUST PIPE

(71) Applicant: Faurecia Emissions Control Technologies, Germany GmbH, Augsburg (DE)

(72) Inventors: Holger Lampe, Langweid (DE); Bernhard Mayereder, Diedorf (DE); Julian Raphael Olm, Baden Soden-Salmuenster (DE)

(73) Assignee: Faurecia Emissions Control Technologies, Germany GmbH (DE)

( * ) Notice: Subject to any disclaimer, the term of this patent is extended or adjusted under 35 U.S.C. 154(b) by 0 days.

(21) Appl. No.: 15/803,953

(22) Filed: Nov. 6, 2017

(65) Prior Publication Data

US 2018/0058300 A1 Mar. 1, 2018

Related U.S. Application Data

(62) Division of application No. 13/602,862, filed on Sep. 4, 2012, now Pat. No. 9,840,960.

(30) Foreign Application Priority Data

Sep. 5, 2011 (DE) ..... 10 2011 112 633

(51) Int. Cl.
*B60K 13/04* (2006.01)
*F01N 13/18* (2010.01)

(52) U.S. Cl.
CPC ..... *F01N 13/1805* (2013.01); *F01N 13/1872* (2013.01); *F01N 2450/22* (2013.01)

(58) Field of Classification Search
CPC ..... F01N 13/1805; F01N 13/1872; F01N 2450/22

(Continued)

(56) References Cited

U.S. PATENT DOCUMENTS 3,888,439 A * 6/1975 Tuttle ..... F16L 3/14 180/311
3,960,232 A * 6/1976 Hubbell ..... F01N 13/1805 180/309

(Continued)

FOREIGN PATENT DOCUMENTS

JP 57160149 4/1984
JP 59-129401 3/1986

(Continued)

OTHER PUBLICATIONS

Translated JP office action.
English summary of CN office action dated Jun. 12, 2016.
English translation of JP office action, dated Jan. 31, 2017.

*Primary Examiner* — James M Dolak
(74) *Attorney, Agent, or Firm* — Carlson, Gaskey & Olds, P.C.

(57) ABSTRACT

An exhaust pipe assembly comprises an exhaust pipe extending along a pipe axis and a fastening panel that is mounted to the exhaust pipe. The cross-section of the fastening panel is configured in a curved manner, and two contact surfaces of the fastening panel, which are spaced apart in the circumferential direction, are soldered to the exhaust pipe. A support connected with the fastening panel is arranged between the two contact surfaces of the fastening panel. The fastening panel can be fastened to the exhaust pipe by the following steps: an exhaust pipe and a sheet-metal tab are provided; a soldering material is then captively fixed to the sheet-metal tab; and the sheet-metal tab is then arranged on the exhaust pipe such that the soldering material contacts the exhaust pipe to finally solder the sheet-metal tab to the exhaust pipe.

16 Claims, 3 Drawing Sheets

(58) Field of Classification Search
USPC ..... 180/309, 225, 296, 89.2; 60/796, 770, 60/771, 39.5, 39.37; 248/58, 62, 63, 65, 248/72, 73, 74.1; 138/106
See application file for complete search history.

(56) References Cited

U.S. PATENT DOCUMENTS

| | | | | |
|---|---|---|---|---|
| 5,890,685 | A | 4/1999 | Takahashi | |
| 6,123,143 | A | 9/2000 | Insalaco | |
| 6,298,935 | B1 | 10/2001 | Steenackers et al. | |
| 6,758,300 | B2 * | 7/2004 | Kromis | B60K 13/04 180/296 |
| 7,571,880 | B2 | 8/2009 | Perez | |
| 8,100,438 | B2 * | 1/2012 | Grimm | F01N 13/1805 285/289.1 |
| 8,882,155 | B2 * | 11/2014 | Dittly | F28F 9/0251 285/133.11 |
| 8,905,188 | B2 * | 12/2014 | Park | F01N 13/00 181/268 |
| 9,243,734 | B2 * | 1/2016 | Aubert | B08B 15/002 |
| 10,316,729 | B2 * | 6/2019 | Oakes | B60K 13/04 |
| 2001/0047897 | A1 | 12/2001 | Steenackers et al. | |
| 2003/0155169 | A1 | 8/2003 | Kromis et al. | |
| 2005/0184201 | A1 | 8/2005 | Komitsu et al. | |
| 2009/0211832 | A1 | 8/2009 | Grimm | |
| 2009/0261574 | A1 | 10/2009 | Blueml et al. | |
| 2011/0114216 | A1 | 5/2011 | Blueml et al. | |

FOREIGN PATENT DOCUMENTS

| | | |
|---|---|---|
| JP | H9-4448 | 1/1997 |
| JP | 2010258362 A | 11/2010 |

* cited by examiner

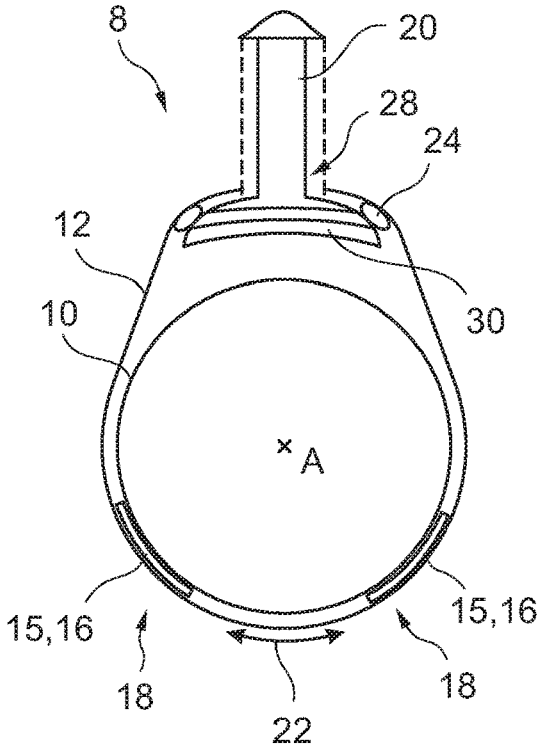
Fig. 7
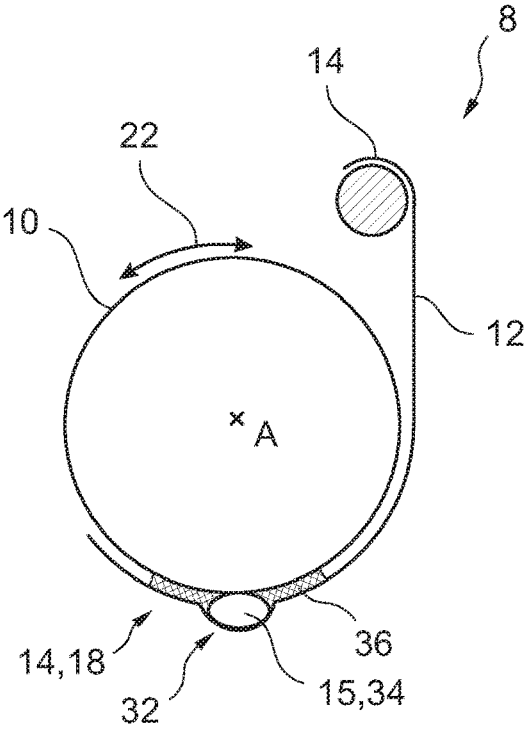
Fig. 8
Fig. 9
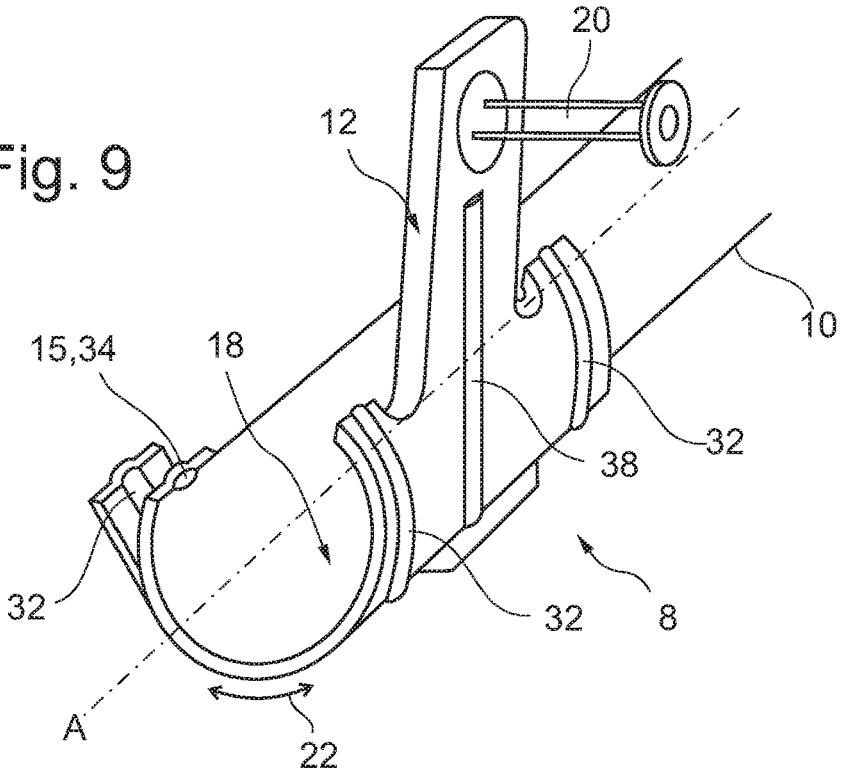

EXHAUST PIPE ASSEMBLY AND METHOD OF FASTENING A SHEET-METAL TAB TO AN EXHAUST PIPE

RELATED APPLICATION

This application is a divisional of U.S. patent application Ser. No. 13/602,862, filed Sep. 4, 2012, which claims priority to German Application No. 10 2011 112 633.7, filed 5 Sep. 2011.

TECHNICAL FIELD

The invention relates to an exhaust pipe assembly and to a method of fastening a sheet-metal tab or a fastening panel to an exhaust pipe to obtain an exhaust pipe assembly.

BACKGROUND OF THE INVENTION

It is generally known to weld a support to an exhaust pipe, which serves to mount the exhaust system to a vehicle, for example to the underbody of the vehicle by rubber bearings. It is disadvantageous that such a welded joint locally restricts the vibration resistance of the exhaust pipe, as a welded joint constitutes a cross-sectional change. The welded joint furthermore requires a comparatively large wall thickness to be used for the exhaust pipe, such that the so-called "fusion penetration", which is necessary for the connection in the welding process, can develop but an undesired "burn through" of the pipe is reliably prevented.

The object of the invention is to permit the fastening of an exhaust pipe with little effort and at low costs.

SUMMARY OF THE INVENTION

An exhaust pipe assembly comprises an exhaust pipe extending along a pipe axis and a fastening panel mounted to the exhaust pipe. The cross-section of the fastening panel is configured in a curved manner. Two contact surfaces of the fastening panel, which are spaced apart in the circumferential direction, are soldered to the exhaust pipe. A support connected with the fastening panel is arranged between the two contact surfaces of the fastening panel.

A method of fastening a sheet-metal tab to an exhaust pipe is also provided, in which an exhaust pipe and a sheet-metal tab are at first provided, with the exhaust pipe extending along a pipe axis. A soldering material is then captively fixed to the sheet-metal tab, and the sheet-metal tab is placed on the exhaust pipe such that the soldering material contacts the exhaust pipe. The sheet-metal tab is then soldered to the exhaust pipe.

The concept is to use, with the fastening panel or the fastening tab, respectively, a comparatively large-surface component as an "adapter" that is arranged between the fastening element and the exhaust pipe. The fastening panel can transmit the loads occurring due to the soldered joint into the exhaust pipe over a very large surface, such that it is possible to use a smaller wall thickness for the exhaust pipe.

The fixing of the soldering material to the fastening panel increases the process reliability, as an undesired slipping or falling out of the soldering material, and thus an imperfect soldering of the components upon positioning of the fastening panel with respect to the exhaust pipe is reliably prevented.

In an embodiment of the exhaust pipe assembly, the two contact surfaces of the fastening panel are arranged opposite each other, i.e. the contact surfaces are arranged on opposite faces of the exhaust pipe. The longitudinal edges of the fastening panel can in particular be configured as a contact surface.

A solder strip, in particular a rectangular solder strip is preferably arranged along the contact surfaces of the fastening panel. The (rectangular) solder strip ensures a large-surface soldered joint which, on the one hand, withstands high loads and, on the other hand, does not adversely affect the vibration resistance of the exhaust pipe.

The solder strip is preferably larger than the contact region between the fastening panel and the exhaust pipe. As the solder strip is larger than the contact region (which is only linear as considered from a mathematical point of view) between the fastening panel and the exhaust pipe, it is possible to simply compensate tolerances by correcting the positioning of the fastening panel with respect to the exhaust pipe. The solder strip is large enough such that a reliable solder point can always be formed.

In a further embodiment, each contact surface of the fastening panel has a bead for receiving a soldering material, the soldering material being for example a solder wire. The bead preferably extends along the pipe axis or in the circumferential direction, i.e. in a plane perpendicular to the pipe axis.

The support is preferably firmly connected with, in particular welded or soldered to the fastening panel. For this firm connection, a desired fastening method can be chosen depending on the respective demands, wherein it is uncritical if a slightly larger wall thickness of the fastening panel is required for welding. The fastening panel has comparatively small dimensions so that the additional costs resulting therefrom are kept within narrow limits. Incidentally, in order to form a firm connection, the support and the fastening panel can also be compressed or bonded together. Alternatively, a detachable connection, for example a screwed connection between the support and the fastening panel is also conceivable.

The support can be connected with the fastening panel after, or also before, soldering the fastening panel to the exhaust pipe. In case the fastening element is to be welded to the fastening panel, it is advantageous in view of the accessibility of the welded point, to weld the fastening element prior to that.

In the method described above of fastening a fastening panel or a sheet-metal tab to an exhaust pipe, the soldering material is preferably applied to the sheet-metal tab as a solder paste, or is applied to the sheet-metal tab as a solder powder using a printing method, in particular a screen-printing method. When it has an appropriate suitability, the soldering material can also be applied using a spraying method or a dipping method. It is furthermore of course also conceivable to apply the soldering material manually. In these cases, the adhesion between the soldering material and the sheet-metal tab is sufficient to ensure a captive connection.

Alternatively, the soldering material can be configured as a solder strip or as a solder wire and can be fixed captively to the sheet-metal tab by at least one weld or solder point. In some variant embodiments, it is also conceivable that the solder wire is configured in a resilient manner and can be clipped in the sheet-metal tab, in particular in a bead of the sheet-metal tab.

In a variant method, the sheet-metal tab provided has a curved cross-section and at least one contact surface to which the soldering material is captively fixed.

Preferably, substantially opposite longitudinal edges of the sheet-metal tab are configured as contact surfaces, wherein in the initial state of the sheet-metal tab, the longitudinal edges are arranged opposite each other at a distance which is smaller than the diameter of the exhaust pipe. In this configuration, the elasticity of the curved sheet-metal tab can be used both to cause an automatic compensation of tolerances and to ensure that the soldering material of the sheet-metal tab rests against the outer wall of the exhaust pipe. In this way, a correct solder point is reliably obtained.

As already mentioned above, a support can be connected with, in particular soldered or welded to the sheet-metal tab.

In the exhaust pipe assembly obtained from the method mentioned above, the sheet-metal tab can be configured as a hollow cylinder having a closed cross-section, at least the exhaust pipe, and in some variant embodiments also the support extending through the hollow cylinder. This box section of the sheet-metal tab provides for a comparatively low stress of the soldered joint in particular in case of loads perpendicular to the pipe axis.

In some embodiments of the exhaust pipe assembly, it turned out that a flat configuration of the exhaust pipe and of the sheet-metal tab, at least in the region of the adjacent soldering material, has an advantageous effect on the soldered joint.

The sheet-metal tab of the exhaust pipe assembly obtained from the method mentioned above can have at least one bead for receiving the soldering material, the bead preferably extending in the axial direction or in the circumferential direction. Such a bead can be configured with low expenditure and contributes in a simple manner to the captive fixing of the soldering material to the sheet-metal tab before soldering the sheet-metal tab and the exhaust pipe.

These and other features may be best understood from the following drawings and specification.

BRIEF DESCRIPTION OF THE DRAWINGS

The invention is described below with reference to various embodiments which are illustrated in the accompanying drawings, which show:

FIG. 7 is a schematic cross-section of the exhaust pipe assembly of the invention according to a further embodiment;

FIG. 8 is a schematic cross-section of the exhaust pipe assembly of the invention according to a further embodiment; and FIG. 9 is a schematic, perspective view of the exhaust pipe assembly of the invention according to a further embodiment.

DETAILED DESCRIPTION

Figure 1:
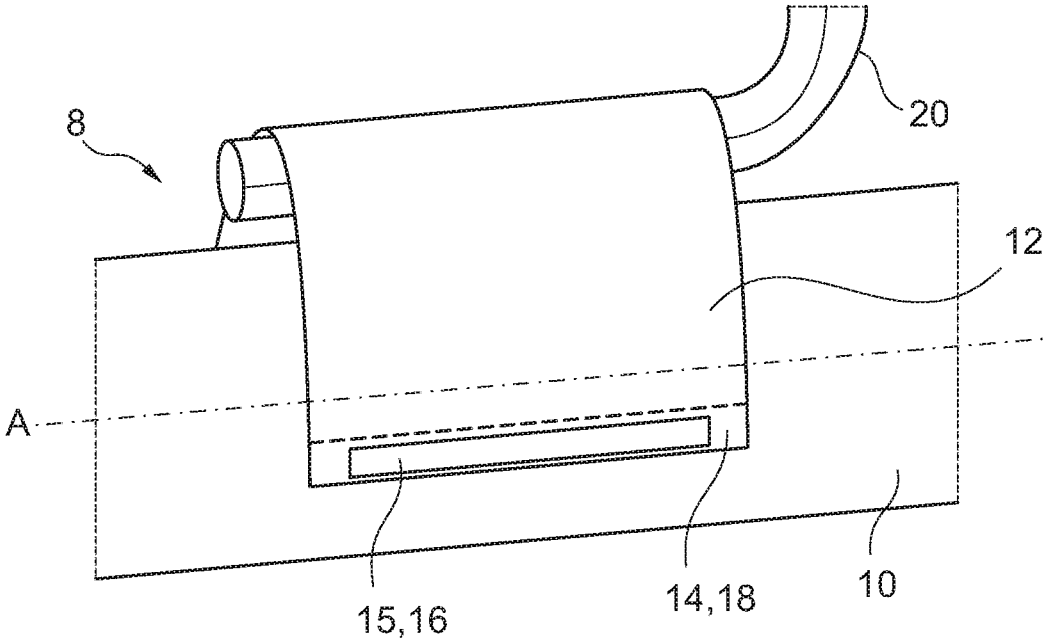
FIG. 1 is a schematic, perspective view of the exhaust pipe assembly of the invention according to an embodiment.

The figures show various embodiments of an exhaust pipe assembly 8. The exhaust pipe 8 respectively comprises an exhaust pipe 10 which is part of an exhaust system as is, for example, used in motor vehicles. The exhaust pipe 10 extends along a pipe axis A and is mounted to a support 20 by a fastening panel 12 or a sheet-metal tab 12, the support fastening the exhaust pipe 10 and thus the exhaust system to an underbody of the motor vehicle, for example.

Figure 2:
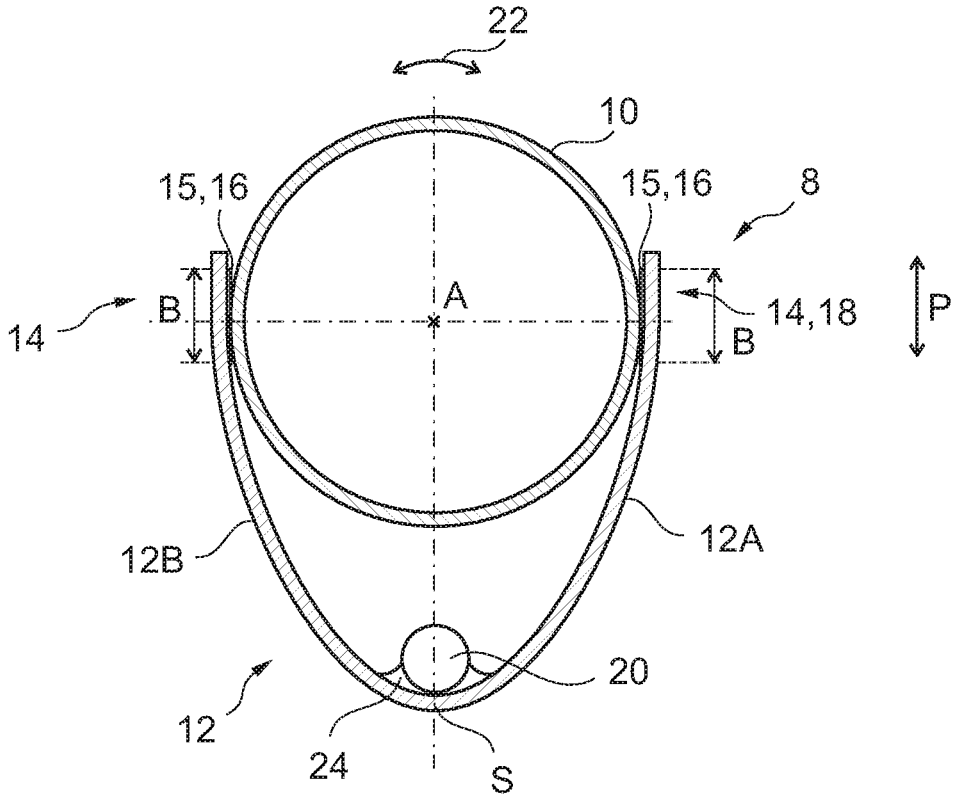
FIG. 2 is a schematic cross-section of the exhaust pipe assembly according to FIG. 1.

In the example embodiment according to FIGS. 1 and 2, the fastening panel 12 mounted to the exhaust pipe 10 is bent starting from a rectangular form such that a curved, generally C-shaped form having two legs 12A, 12B is obtained. The fastening panels 12 can of course differ from the illustrated rectangular initial form, and for example, can obtain an optimized panel shape with regard to the occurring material stresses.

Each of the legs 12A, 12B comprises at its free end facing away from a vertex S of the fastening panel 12, a respective longitudinal edge 14, with the two longitudinal edges 14 being arranged opposite each other. Each of the longitudinal edges 14 is provided with a soldering material 15 on the side facing the other longitudinal edge 14, i.e. on the inside of the fastening panel 12, the soldering material 15 being captively fixed to the fastening panel 12.

The soldering material 15 configured as a solder strip 16 is, for example, applied to the fastening panel as a solder paste or as a solder powder using a printing method, preferably a screen-printing method. Depending on the properties, in particular on the consistence, an application of the soldering material 15 using a spraying or dipping method is also conceivable. However, the soldering material 15 can of course also be applied manually. In the mentioned cases, the adhesion between the soldering material 15 and the fastening panel 12 is sufficient to ensure the desired, captive connection. Alternatively, the soldering material 15 can also be a strip-like solder film which is however then fixed to the fastening panel 12 by at least one weld or solder point to ensure a captive connection.

The longitudinal edges 14 according to FIGS. 1 and 2 are, in more general terms, two contact surfaces 18 spaced apart from each other in the circumferential direction 22, to which the fastening panel 12 is soldered along with the exhaust pipe 10. The soldering material 15 is captively fixed to the fastening panel 12, specifically to the contact surfaces 18 thereof before the fastening panel 12 is soldered to the exhaust pipe 10.

The fastening panel 12 is connected with the exhaust pipe 10 by arranging the exhaust pipe between the two longitudinal edges 14 that are arranged opposite each other (and thus between the two solder strips 16), the region to be soldered being then heated, for example, by an induction device such that the soldering material 15 fuses.

For a loadable solder point, it is necessary that the two longitudinal edges 14 of the fastening panel 12 contact the outer surface of the exhaust pipe 10 or are arranged at a small distance therefrom. To ensure this, it can be provided that in the initial state, the distance of the longitudinal edges 14 from each other is slightly smaller than the outer diameter of the exhaust pipe 10. As a result, the two legs 12A, 12B are slightly bent elastically when the fastening panel 12 is mounted to the exhaust pipe 10. It is thus ensured that the solder strips 16 contact the exhaust pipe 10. It may also be provided that the two longitudinal edges 14 are adjusted to be slightly oblique, i.e. to have a funnel-shaped cross-section, so that they are automatically positioned on the outer surface of the exhaust pipe 10 similar to two insertion bevels when the fastening panel 12 is mounted thereto.

The two solder strips 16 extend over nearly the entire length of the longitudinal edges 14 and have a width B which is slightly larger than the width for which a proper solder point would actually be sufficient. In this way, a certain free play is permitted within which the fastening panel 12 can be positioned with respect to the exhaust pipe 10. With respect to FIG. 2, the fastening panel 12 can be shifted upwards or downwards in the direction of the arrow P with respect to the exhaust pipe 10. Due to the width of the solder strip 16, it is ensured in any of these positions that the fastening panel 12 can be soldered to the exhaust pipe 10 in the desired manner. In addition, the fastening panel 12 may also be shifted in an axial direction with respect to the exhaust pipe 10, and along the exhaust pipe 10 to generate a compensation of tolerances also in the longitudinal direction.

Connected with the fastening panel 12 is a support 20 which in the example embodiment according to FIGS. 1 and 2 is configured as a metal rod and which is firmly connected with an inside of the fastening panel 12 in the region of the vertex S. A welded or soldered joint 24 as schematically shown in FIG. 2 can in particular be used to this end.

Alternatively, the support 20 can also be made of plastic material, in particular of fiber reinforced plastic material. In other variant embodiments, the support 20 can be compressed with, or bonded to, the fastening panel 12. Apart from the firm connections between the support 20 and the fastening panel 12 mentioned above, a detachable connection is furthermore also conceivable, in which the fastening panel 12 is, for example, screwed to the support 20.

The support 20 serves first of all to mount the exhaust pipe 10 or the exhaust system to the underbody of a vehicle. However, the support 20 can also take further functions, and for example can be configured as a vibration absorber or as a pressure pipe for fluids.

FIGS. 3 to 9 show further embodiments of the exhaust pipe assembly 8, equivalent components having identical reference numbers. Concerning the general structure of the exhaust pipe assembly 8 and the basic manufacture thereof, reference is explicitly made to the description above, and merely the differences with respect to the embodiment according to FIGS. 1 and 2 are discussed below. The features described with reference to a specific embodiment can suitably be combined in any way with further embodiments.

Figure 3:
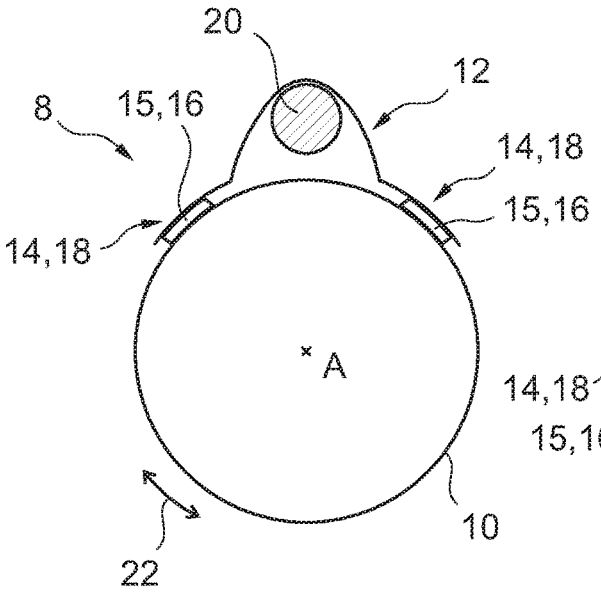
FIG. 3 is a schematic cross-section of the exhaust pipe assembly of the invention according to a further embodiment.

FIG. 3 shows an embodiment of the exhaust pipe assembly 8 in which the longitudinal edges 14 configured as contact surfaces 18 for soldering to the exhaust pipe 10 are spaced apart from each other in the circumferential direction 22. Unlike the embodiment according to FIGS. 1 and 2, the contact surfaces 18 are however not arranged opposite each other with respect to the exhaust pipe 10.

Figure 4:
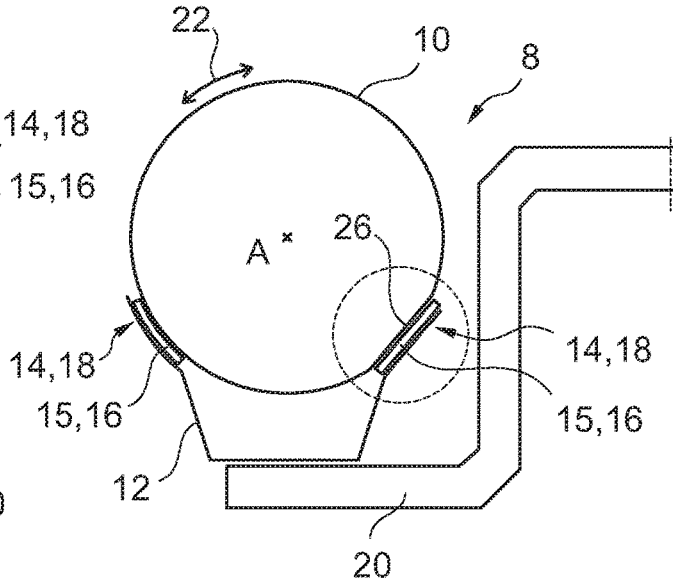
FIG. 4 is a schematic cross-section of the exhaust pipe assembly of the invention according to a further embodiment.

FIG. 4 shows a further embodiment of the exhaust pipe assembly 8 in which the fastening panel 12 is substantially configured as a U-profile. Unlike the previous embodiments, the support 20 is fastened on the outer surface of the fastening panel 12 rather than to an inside thereof, i.e. on a side facing the exhaust pipe 10. In FIG. 4, the possibility is further pointed out that the exhaust pipe 10 and the fastening panel 12 can be configured in a flat manner at least in the region of the adjacent soldering material 15 (cf. soldered joint circled in a dashed line). To this end, the exhaust pipe 10 which usually has a curved, in particular circularly curved cross-section, is reshaped accordingly before the fastening of the sheet-metal tab 12 so that flat pipe sections 26 are formed.

Figure 5:
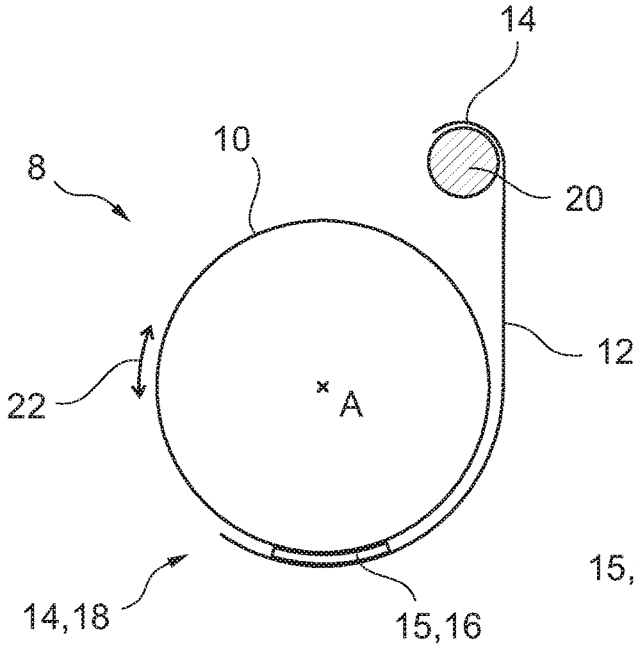
FIG. 5 is a schematic cross-section of the exhaust pipe assembly of the invention according to a further embodiment.

In a further embodiment of the exhaust pipe assembly 8 shown in FIG. 5, the fastening panel 12, in contrast to the previous embodiments, has merely one contact surface 18 soldered to the exhaust pipe 10. In this case, a longitudinal edge 14 of the fastening panel 12 is configured as a contact surface 18 to which the soldering material 15 is captively fixed, this contact surface 18 being soldered to the exhaust pipe 10. An opposite longitudinal edge 14 of the fastening panel 12 engages the support 20 and is firmly (e.g. by soldering, welding) or detachably (e.g. by screwing) connected therewith.

Figure 6:
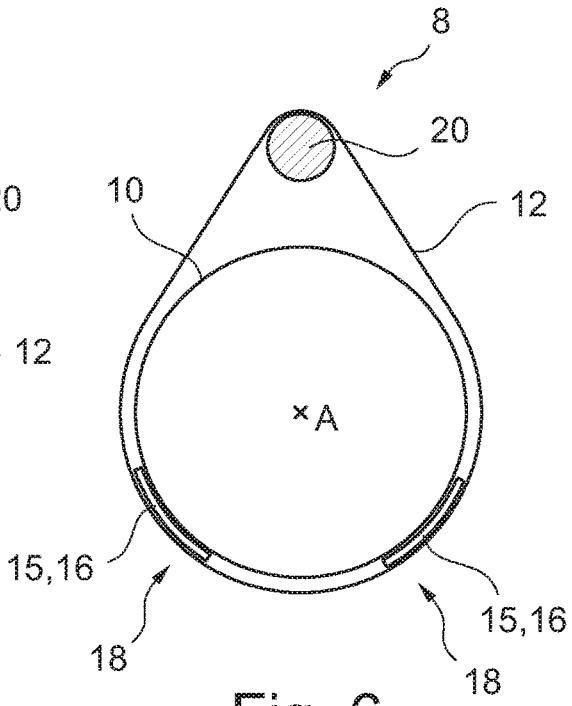
FIG. 6 is a schematic cross-section of the exhaust pipe assembly of the invention according to a further embodiment.

FIG. 6 shows an embodiment in which the fastening panel 12 is configured as a "box cross-section", i.e. as hollow cylinder having a closed cross-section, the exhaust pipe 10 and the support 20 extending through the hollow cylinder.

The variant embodiment according to FIG. 7 differs merely in the design of the support 20 and the fastening thereof to the fastening panel 12. The pin-shaped support 20 extends in this case through a recess 28 in the fastening panel 12 and has an end 30 widened in a plate-shaped manner by which it is mounted to the fastening panel 12. The end 30 of the support 20 which is widened in a plate-shaped manner is in particular firmly connected with the fastening panel 12 by a schematically indicated welded or soldered joint 24.

FIG. 8 illustrates an embodiment of the exhaust pipe assembly 8 in which the fastening panel 12 has a bead 32 for receiving the soldering material 15, the bead 32 extending in the axial direction, and the soldering material 15 being in this case preferably a solder wire 34. Due to the heating of the soldering material 15 in the soldering process, the soldering material 15 fuses and is drawn by capillary forces into the gap between the exhaust pipe 10 and the fastening panel 12 adjacent the bead 32, so that a large-surface soldering region 36 is formed, as indicated in FIG. 8 in a hatched manner.

In contrast to FIG. 8, FIG. 9 finally shows an embodiment in which two beads 32 for receiving the soldering material 15 extend in the circumferential direction 22 of the fastening panel 12. In addition, the fastening panel 12 has a further bead 38 which however only serves for reinforcement and usually does not receive any soldering material 15. In this example embodiment, it is conceivable that the solder wire 34 is not fixed to the fastening panel 12 by a weld or solder point, but that the solder wire 34 is configured to be elastic and can be clipped into the fastening panel 12, in particular into the beads 32 of the fastening panel 12 such that it is captively fixed to the fastening panel.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An exhaust pipe assembly comprising:

a support;

an exhaust pipe to be connected to said support and extending along a pipe axis; and a fastening panel mounted to said exhaust pipe and connected to said support, said fastening panel having a first curved cross-section to receive and accommodate said exhaust pipe and a second curved cross-section to connect to said support, said fastening panel having a contact surface provided with soldering material, and wherein said fastening panel includes a panel body extending from a first free end comprising said first curved cross-section to a second free end comprising said second curved cross-section, and wherein said first free end comprises a first longitudinal edge having a first length extending in a direction along said pipe axis and wherein said second free end comprises a second longitudinal edge having a second length extending in a direction along said pipe axis, and wherein said exhaust pipe is soldered to said contact surface with said soldering material.

2. The exhaust pipe assembly of claim 1 wherein said soldering material is captively fixed to said contact surface.

3. The exhaust pipe assembly of claim 1 wherein the fastening panel includes end portions, and wherein said contact surface is arranged adjacent one of the end portions that is opposite the end portion associated with said support.

4. The exhaust pipe assembly of claim 1 wherein said fastening panel is connected to said support at an end portion which is opposite said exhaust pipe.

5. The exhaust pipe assembly of claim 4 wherein said end portion is connected to said support by at least one of: solder material, weld material, or at least one screw.

6. The exhaust pipe assembly of claim 1 wherein said solder material is provided in the form of a solder strip arranged along said contact surface.

7. The exhaust pipe assembly of claim 1 wherein said soldering material is provided as a solder paste or a solder powder.

8. The exhaust pipe assembly of claim 1 wherein said contact surface of said fastening panel has a bead that receives said soldering material.

9. The exhaust pipe assembly of claim 8 wherein said bead extends in an axial direction.

10. The exhaust pipe assembly of claim 8 wherein said bead extends in a circumferential direction.

11. The exhaust pipe assembly of claim 1 wherein said contact surface comprises a single contact surface that is soldered to said exhaust pipe.

12. An exhaust pipe assembly comprising:

a support;

an exhaust pipe to be connected to said support and extending along a pipe axis; and a fastening panel mounted to said exhaust pipe and connected to said support, said fastening panel having a first curved cross-section to receive and accommodate said exhaust pipe and a second curved cross-section to connect to said support, said fastening panel having a contact surface provided with soldering material, and wherein said fastening panel includes a panel body extending from a first longitudinal edge to a second longitudinal edge, and wherein said contact surface to which said soldering material is captively fixed is adjacent to said first longitudinal edge, and wherein said second longitudinal edge comprises said second curved cross-section that engages said support; and wherein said exhaust pipe is soldered to said contact surface with said soldering material.

13. The exhaust pipe assembly of claim 12 wherein said panel body comprises a J-shape that extends from said first longitudinal edge, along said first curved cross-section, and then toward said support, and wherein said second curved cross-section extends from a top of the J-shape to curve around said support.

14. The exhaust pipe assembly of claim 1 wherein said contact surface extends along said first longitudinal edge.

15. The exhaust pipe assembly of claim 14 wherein said soldering material comprises a strip extending along said contact surface.

16. The exhaust pipe assembly of claim 15 wherein said strip extends adjacent to said first longitudinal edge along said first length which extends from one end of said first longitudinal edge to an opposite end of said longitudinal edge.

* * * * *